US010041217B2

(12) United States Patent
An

(10) Patent No.: US 10,041,217 B2
(45) Date of Patent: Aug. 7, 2018

(54) TRAFFIC BARRIER STRUCTURE

(71) Applicant: ETI Ltd., Wanju-Gun (KR)

(72) Inventor: Eun Hee An, Wanju-Gun (KR)

(73) Assignee: ETI LTD., Wanju-Gun (KR)

( * ) Notice: Subject to any disclaimer, the term of this patent is extended or adjusted under 35 U.S.C. 154(b) by 0 days.

(21) Appl. No.: 15/426,568

(22) Filed: Feb. 7, 2017

(65) Prior Publication Data

US 2017/0335529 A1 Nov. 23, 2017

(30) Foreign Application Priority Data

May 19, 2016 (KR) ..... 10-2016-0061268

(51) Int. Cl.
*E01F 15/04* (2006.01)
*E01F 15/02* (2006.01)
*E01F 15/14* (2006.01)

(52) U.S. Cl.
CPC ..... *E01F 15/04* (2013.01); *E01F 15/025* (2013.01); *E01F 15/0461* (2013.01); *E01F 15/146* (2013.01)

(58) Field of Classification Search
CPC . E01F 15/00; E01F 15/02; E01F 15/04; E01F 15/0407; E01F 15/0423; E01F 15/0438
See application file for complete search history.

(56) References Cited

U.S. PATENT DOCUMENTS 8,282,082 B2 * 10/2012 An ..... E01F 15/025 256/13.1
8,434,965 B2 * 5/2013 Chae ..... E01F 15/003 256/13.1
2008/0251776 A1 * 10/2008 Park ..... E01F 15/0438 256/13.1

FOREIGN PATENT DOCUMENTS

| | | | | |
|---|---|---|---|---|
| EP | 2 048 826 | * | 4/2009 | ..... E01F 15/04 |
| FR | 2 313 503 | * | 12/1976 | ..... E01F 15/00 |
| FR | 2 678 007 | * | 6/1991 | ..... E01F 15/00 |
| KR | 20090048809 | | 5/2009 | |
| KR | 101036550 | | 5/2011 | |
| KR | 10-1083269 | * | 11/2011 | ..... E01F 15/00 |
| KR | 101191896 | | 10/2012 | |
| KR | 101507481 | | 3/2015 | |
| WO | WO 00/40804 | * | 7/2000 | ..... E01F 15/00 |

* cited by examiner

*Primary Examiner* — Michael P Ferguson
(74) *Attorney, Agent, or Firm* — Cantor Colburn LLP

(57) ABSTRACT

A traffic barrier structure includes posts fixedly installed at the median or roadside of the road, guiderail units composed of guiderails horizontally connected in series between the posts and each having a longitudinal slot, a rail holder installed in the guiderail and having a slot holder piece closely engaged against the slot in the guiderail and a deformation-resistant piece extending from the slot holder piece, closely conforming to a portion of an inner curved portion of the guiderail, to prevent deformation of the guiderails and enlargement of the slots when shock is applied the guiderails, and a rail connector inserted into respective connection part of adjacent guiderails to longitudinally connect the adjacent guiderails.

7 Claims, 14 Drawing Sheets
(2 of 14 Drawing Sheet(s) Filed in Color)

[Test for Truck: Impacted Part after Test]

[Test for Car: Impacted Part after Test]

TRAFFIC BARRIER STRUCTURE

BACKGROUND OF THE INVENTION

Field of the Invention

The present invention relates generally to a traffic barrier structure. More particularly, the present invention relates to a traffic barrier structure, in which: extended ends of a rail holder are installed on a portion of an inner surface of a guiderail so as to minimize the deformation of the guiderail when impacted to prevent decoupling of the guiderail from a post and thus prevent the decoupling and scattering of nuts and bolts which may damage a vehicle or injure vehicle occupants; support units are installed on front and rear sides of the post so as to support the guiderail on the post more stably while increasing a contact area and fastening strength with respect to the guiderail; and a reinforcing section is fixed between the post and the guiderail to increase a contact area with the guiderails, thereby further increasing the fastening force with respect to the guiderails.

Description of the Related Art

Generally, on the road, a variety of safety structures are installed for protecting vehicles, drivers, and passengers. Among these safety structures, there are traffic barrier structures that are installed at the median or roadside of the road for the purposes of vehicle lane departure/fall prevention, pedestrian protection, etc.

Such traffic barrier structures may be classified into a fixed-type barrier structure and a buried-type barrier structure that are fixedly installed at or buried into the median or roadside of the road, respectively. As an exemplary fixed-type structure, there may be a structure using fixed concrete blocks. In such a traffic barrier structure, a series of blocks are arranged at the median or roadside of the road and fixedly connected thereto by a means of nuts and bolts.

However, such a fixed-type barrier structure merely serves to prevent errant vehicles from crossing into an opposing lane or falling off the roadside, but cannot absorb shock from vehicle collision.

Thus, there is a problem in that upon vehicle collision, collision shock is wholly transferred to the vehicle to injure vehicle occupants and damage the vehicle itself.

Further, as an exemplary buried-type barrier structure, there may be a structure in which a guiderail or a pair of opposed guiderails are mounted longitudinally between posts using nuts and bolts, and waste tires are fitted and stacked along the post to absorb shock occurring upon vehicle collision.

However, although the buried-type barrier structure has an advantage that shock occurring upon vehicle collision can be absorbed and dispersed to reduce the accident's effect and injury to vehicle occupants, it also has a problem in that upon collision a vehicle is not decelerated, but is temporarily accelerated by bouncing off the tires due to the stacked waste tires causing the vehicle to rotate, thus resulting in a secondary accident through lane departure to an adjoining lane whereby a secondary collision with other vehicles can occur.

Recently, to solve the above problem, proposed is a shock-absorbing traffic barrier structure disclosed in Korean Patent No. 10-1507481 owned by the Applicant.

The traffic barrier structure of the Patent document is configured such that a plurality of posts are fixedly installed, rail frames are connected between the posts, and fixing washers are installed in the rail frames using nuts and bolts to prevent deformation of the rail frames and enlargement of slots.

However, the above barrier structure has a problem in that curved portion of the rail frames are likely to be deformed by external impact occurring upon a vehicle collision, resulting in enlargement of slots in the rail frames, thus leading to decoupling and scattering of the nuts and bolts and causing damage to vehicles or injury to vehicle occupants.

DOCUMENTS OF RELATED ART (Patent Document 1) Korean Patent No. 10-1507481 (2015.03.25)

SUMMARY OF THE INVENTION

Accordingly, the present invention has been made keeping in mind the above problems occurring in the related art, and an object of the present invention is to provide a traffic barrier structure, in which extended ends of a rail holder are installed on a portion of an inner surface of a guiderail so as to minimize the deformation of the guiderail when impacted to prevent decoupling of the guiderail from a post and thus prevent the decoupling and scattering of nuts and bolts to damage a vehicle or injure vehicle occupants.

Another object of the present invention is to provide a traffic barrier structure, in which support units are installed on front and rear sides of the post so as to support the guiderail on the post more stably while increasing a contact area and fastening strength with respect to the guiderail.

A further object of the present invention is to provide a traffic barrier structure, in which a reinforcing section is fixed between the post and the guiderail to increase a contact area with the guiderails, thereby further increasing the fastening force with respect to the guiderails.

In order to achieve the above object, according to one aspect of the present invention, there is provided a traffic barrier structure including: a plurality of posts fixedly installed at regular intervals along the median or roadside of the road; a plurality of guiderail units composed of a plurality of guiderails horizontally connected in series between the posts and each having a longitudinal slot; a rail holder installed in the guiderail of the guiderail unit and having a slot holder piece closely engaged against the periphery of the slot in the guiderail and a deformation-resistant piece extending as an end side from the slot holder piece, closely conforming to a portion of an inner curved portion of the guiderail, in order to prevent deformation of the guiderails and enlargement of the slots when shock is applied to the guiderails; and a rail connector inserted into respective connection part of adjacent guiderails of the guiderail unit to longitudinally connect the adjacent guiderails.

According to the present invention, extended ends of the rail holder are installed on a portion of the inner surface of the guiderail so as to minimize the deformation of the guiderail when impacted to prevent decoupling of the guiderail from the post and thus prevent the decoupling and scattering of nuts and bolts to damage a vehicle or injure vehicle occupants.

Further, according to the present invention, support units are installed on front and rear sides of the post so as to support the guiderail onto the post more stably while increasing a contact area and fastening strength with respect to the guiderail.

Further, according to the present invention, the reinforcing section is fixed between the post and the guiderail to increase a contact area with the guiderails, thereby further increasing the fastening force with respect to the guiderails.

BRIEF DESCRIPTION OF THE DRAWINGS

The file of this patent contains at least one drawing executed in color. Copies of this patent with color drawing(s) will be provided by the Office upon request and payment of the necessary fee.

The above and other objects, features and advantages of the present invention will be more clearly understood from the following detailed description when taken in conjunction with the accompanying drawings, in which.

DETAILED DESCRIPTION OF THE INVENTION

Figure 1:
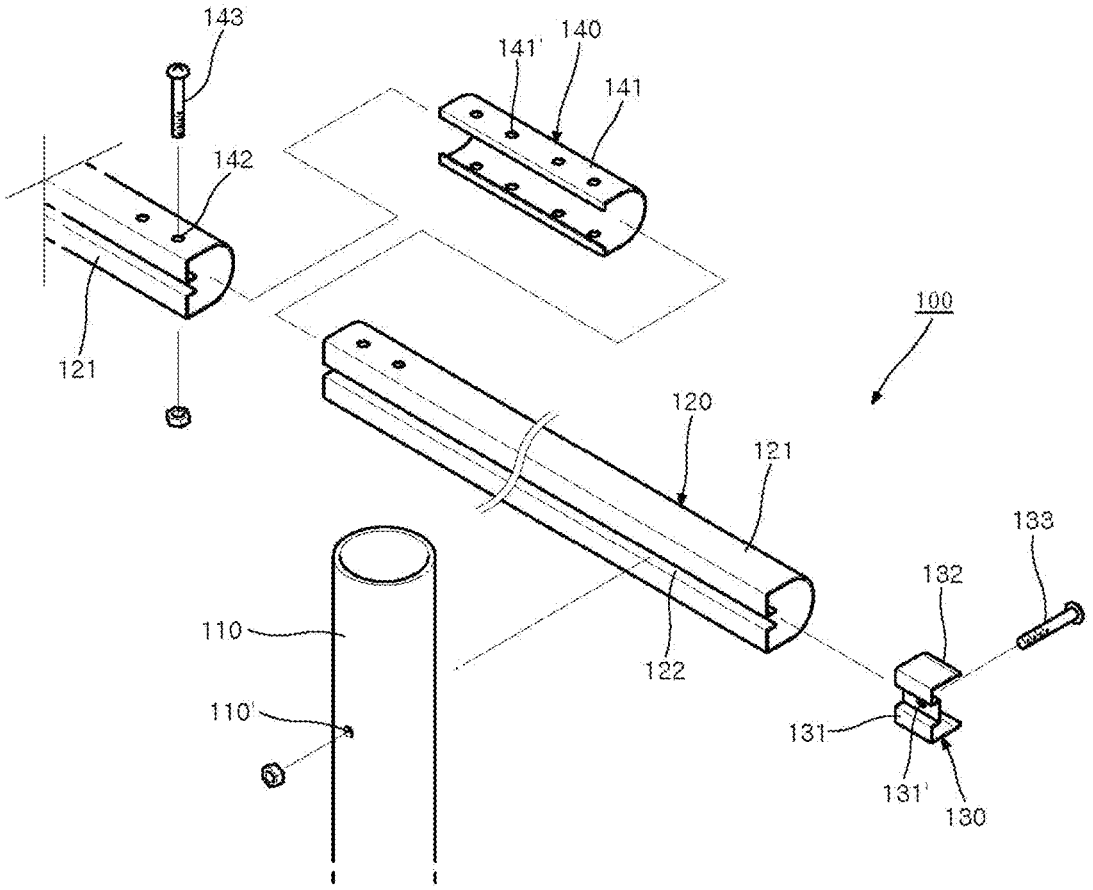
FIG. 1 is an exploded perspective view of a traffic barrier structure according to an embodiment of the present invention.
Figure 2:
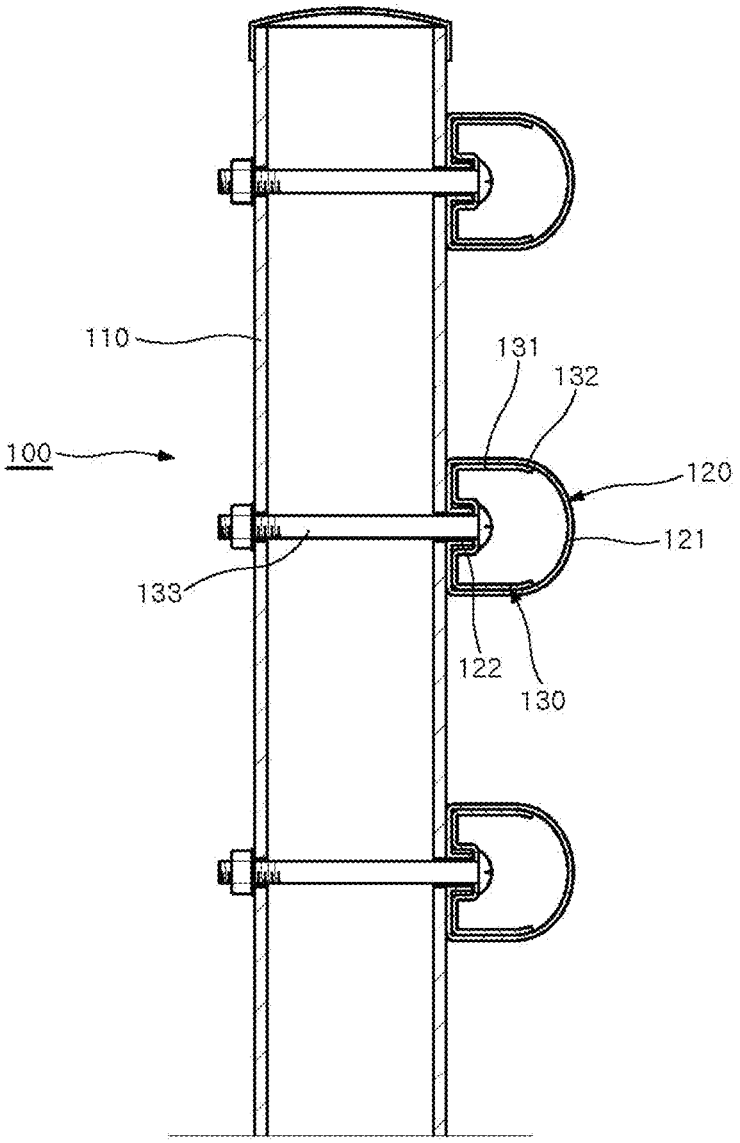
FIG. 2 is a side cross-sectional view of the traffic barrier structure.
Figure 3:
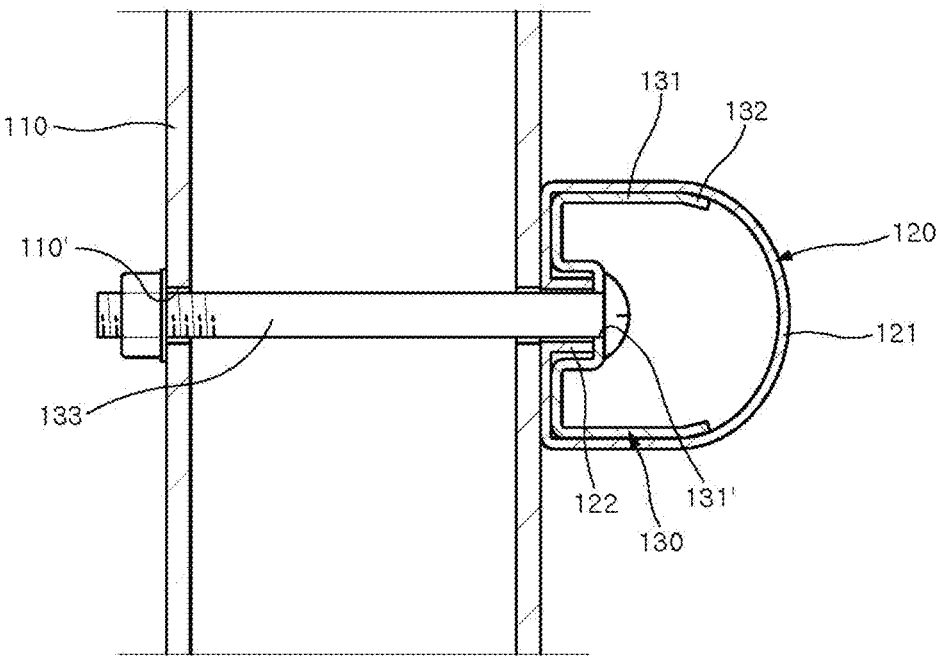
FIG. 3 is a partially-enlarged cross-sectional view of FIG. 2.
Figure 4:
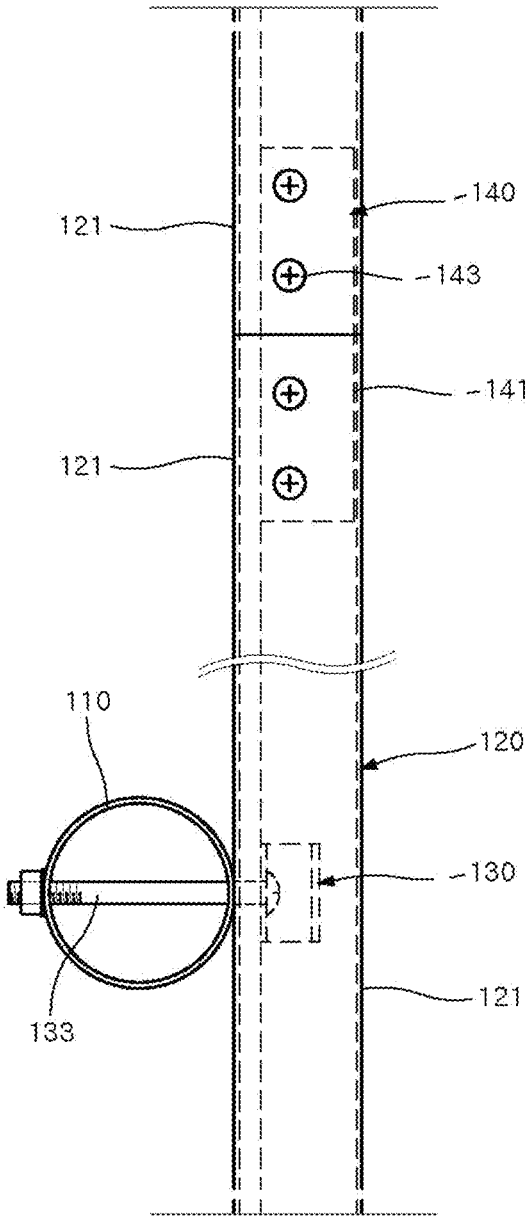
FIG. 4 is a top view of the traffic barrier structure.

Reference will now be made in greater detail to a preferred embodiment of the invention, an example of which is illustrated in the accompanying drawings. It should be understood that the present invention may be implemented into diverse other forms, and is not limited to the disclosed embodiments.

A traffic barrier structure 100 according to the present invention includes: a plurality of posts 110 fixedly installed at regular intervals along the median or roadside of the road; a plurality of guiderail units 120 composed of a plurality of guiderails 121 horizontally connected in series between the posts 110 and each having a longitudinal slot 122; a rail holder 130 installed in the guiderail 121 of the guiderail unit 120 and having a slot holder piece 131 closely engaged against the periphery of the slot 122 in the guiderail 121 and a deformation-resistant piece 132 extending as an end side from the slot holder piece 131, closely conforming to a portion of an inner curved portion of the guiderail 121, in order to prevent deformation of the guiderails 121 and enlargement of the slots 122 when the guiderails 121 are applied with shock; and a rail connector 140 inserted into respective connection part of adjacent guiderails 121 of the guiderail unit 120 to longitudinally connect the adjacent guiderails 121. A more specific description thereof is as follows.

The rail holder 130 includes the slot holder piece 131 that is closely curved along the slot 122 of the guiderail 121 and extends to upper and lower horizontal portions of the guiderail 121 inside the guiderail, the deformation-resistant piece 132 bent and extending as an end side from the upper and lower horizontal portions of the guiderail 121 to closely conform to a portion of the inner curved portions of the guiderail 121, and a fastening member 133 fastening the guiderail 121 to the post 110 through a bolt hole 131' formed in the slot holder piece 131.

The rail connector 140 has a connection insert 141 inserted into the connection part of adjacent guiderails 121, the connection insert having through-holes 141', connection holes 142 formed in the connection part of the adjacent guiderails 121, and connection members 143 fitted through the connection holes 142 and the through-holes 141' of the connection insert 141 so as to longitudinally connect the adjacent guiderails 121.

When the connection part of the adjacent guiderails 121 of the guiderail units 120 is positioned at the post 110, the rail connector 140 is inserted into the connection part of the adjacent guiderails 121 to longitudinally connect the guiderails. Here, a holder unit 150 is further provided in the rail connector 140 so as to be fastened to the post 110, in order to prevent deformation of the guiderails 120 and enlargement of the slots 122 in the case of a collision.

The holder unit 150 has a washer-type body and a fastening member 153 fastening the guiderails 121 to the post 110 through the washer-type body. The washer-type body consists of a slot holder piece 151 closely curved along the slot 122 of the guiderails 121 in the connection insert and a deformation-resistant piece 152 bent perpendicular to an end of the slot holder piece 151 to closely conform to an inner portion of the rail connector 140. The fastening member 153 fastens the guiderails to the post 110 through a bolt-hole 151 formed in the slot holder piece 151.

The guiderail 121 is installed on either one side or both sides of the post 110. When the guiderail 121 is installed on both sides of the post 110, a support unit 160 is further provided on front and rear sides of the post 110 in order to support the opposed guiderails 121 while increasing a contact area with the guiderails 121 to reinforce the fastening strength with respect to the guiderails.

The support unit 160 has a support body part 161 closely abutted on the post, support plates 162 bent from both sides of the support body part 161 so as to be brought into close contact with the guiderails 121, and a fastening member 163 fastening the support body part 161 and the support plates 162 to the post 110 and the guiderails 121, respectively.

The support body part 161 may be further extended to a distance to allow the guiderails 121 to be spaced by the distance from the post 110 so as to absorb shock applied therebetween.

A reinforcing section 170 is further provided between the post 110 and the guiderail unit 120 to increase a contact area and fastening force with respect to the guiderail unit 120.

The reinforcing section 170 has a reinforcing plate part 171 to be closely abutted against an inner side of the guiderail 121, the reinforcing plate part having a through-hole, and bent pieces 172 bent from both ends of the reinforcing plate parts 171 towards the post 110 so as to be closely abutted against an outer surface of the post 110.

An installation procedure of the traffic barrier structure according to the present invention will be described in detail.

First, as illustrated in FIGS. 1 to 4, a plurality of posts 110 are installed at regular intervals along the median or roadside of the road.

The guiderail unit 120 is installed on the post 110. Here, the rail holder 130 is first provided in the guiderail 121 of the guiderail unit 120.

The guiderail unit 120 includes the guiderail 121 having a certain length, and the slot 122 longitudinally formed along the guiderail 121.

The guiderail 121 has a cross section of 'D', which has an outer curved portion serves to disperse external shock, and an inner flat portion along which the slot 122 is formed.

To install the rail holder 130 into the guiderail 121, the rail holder should be installed in a state of a bolt type element of the fastening member 133 being threaded through a bolt-hole 131' of the slot holder piece 131.

The slot holder piece 131 of the rail holder 130 is brought into close contact with the inner surface of the guiderail 121 while covering the slot 122 of the guiderail 121.

Since the slot holder piece 131 extends to upper and lower horizontal portions of the guiderail 121, enlargement of the slot is prevented upon a vehicle collision. Further, since the deformation-resistance piece 132 is formed in a bent form from opposite ends of the slot holder piece 131 so as to closely abut against the inner curved portion of the guiderail 121, the deformation of the curved portion of the guiderail 121 is minimized upon a vehicle collision.

While the rail holder 130 has been described as being fixed to the post 110 using the fastening member 133, the rail holder 130 may be fixed by means of nuts and bolts to be fastened vertically from the guiderail 121.

After the rail holder 130 is installed in the guiderail 121, the guiderail 121 is horizontally fixed to the post 110 by positioning the guiderail 121 at a certain height on one side of the post 110, threading the bolt-type element of the fastening member 133, installed through the rail holder 130, through the fastening hole 110' of the post 110, and then screwing a nut onto the bolt-type element of the fastening member 133.

Further, another guiderail 121 is installed to another post 110 in the same manner.

At a connection part between adjacent guiderails 121, the rail insert 141 of the rail connector 140 is inserted so that connection members 143 having nuts and bolts are fastened through the connection holes 142 formed in the connection part of the guiderails 121 and the through-holes 141' of the connection insert 141, thereby continuously connecting the adjacent guiderails 121 longitudinally.

Another embodiment of the present invention will now be described in detail.

Figure 5:
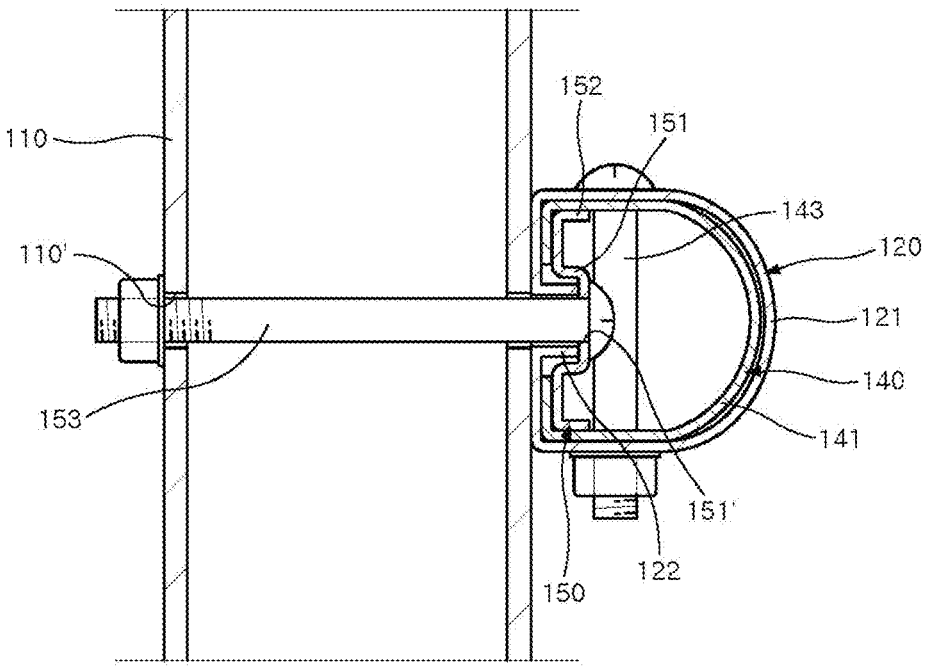
FIG. 5 is a side cross-sectional view showing an assembled state of a connection part of adjacent guiderails being aligned with a post according to an embodiment of the present invention.
Figure 6:
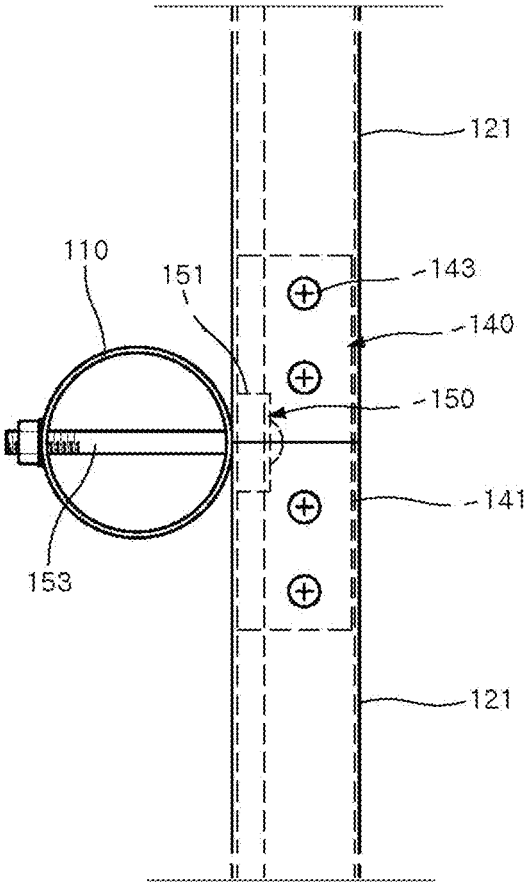
FIG. 6 is a top view showing an assembled state of a connection part of adjacent guiderails being aligned with a post according to an embodiment of the present invention.

First, as illustrated in FIGS. 5 and 6, the guiderails 121 are continuously installed to the posts 110 in such a manner that, when the connection part between adjacent guiderails 121 is aligned with the post 110, at the connection part between adjacent guiderails 121, the rail insert 141 of the rail connector 140 is inserted so that connection members 143 having nuts and bolts are fastened through the connection holes 142 formed in the connection part of the guiderails 121 and the through-holes 141' of the connection insert 141, thereby continuously connecting the adjacent guiderails 121 longitudinally.

Further, the holder unit 150 is coupled in the connection insert 141 so as to fasten the guiderail 121 to the post 110 such that the bolt-type element of the fastening member 153 having nuts and bolts is threaded through the bolt-hole 151' of the slot holder piece 151.

When the slot holder piece 151 fastened with the fastening member 153 is coupled to conform to the slot 122 of the guiderail 121, the deformation-resistant pieces bent from opposite ends of the slot holder piece 151 are closely abutted against the inner surface of the connection insert 141.

After the rail connector 140 and the holder unit 150 are then installed in the guiderail 121, the guiderails 121 are horizontally fixed by positioning the guiderails 121 at a certain height on one side of the post 110, threading the bolt-type element of the fastening member 153 through the fastening hole 110' of the post 110, and then screwing a nut onto the bolt-type element of the fastening member 153.

Thus, since the guiderails 121 are fixed to the post 110 after the rail connector 140 and the holder unit 150 are installed in the connection part of the adjacent guiderails 121, the deformation of the guiderail and the enlargement of the slot 122 can be minimized.

Figure 7:
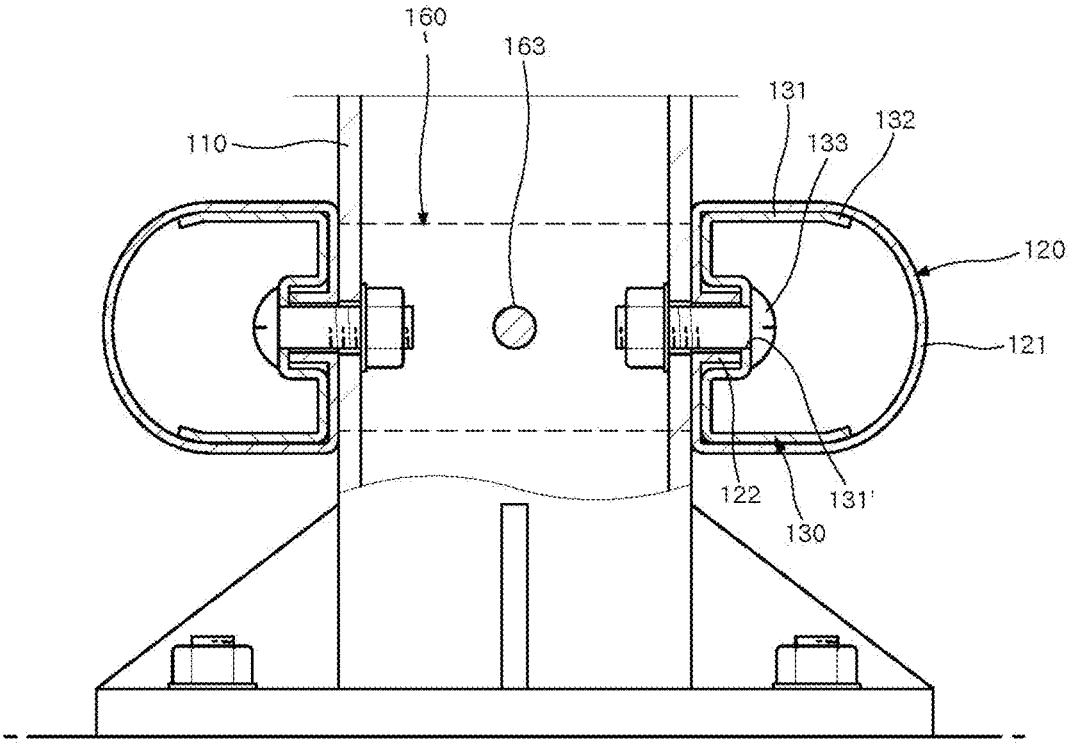
FIG. 7 is a side cross-sectional view showing the state in which guiderails are installed on opposite sides of the post and the support unit is fixed therebetween.
Figure 8:
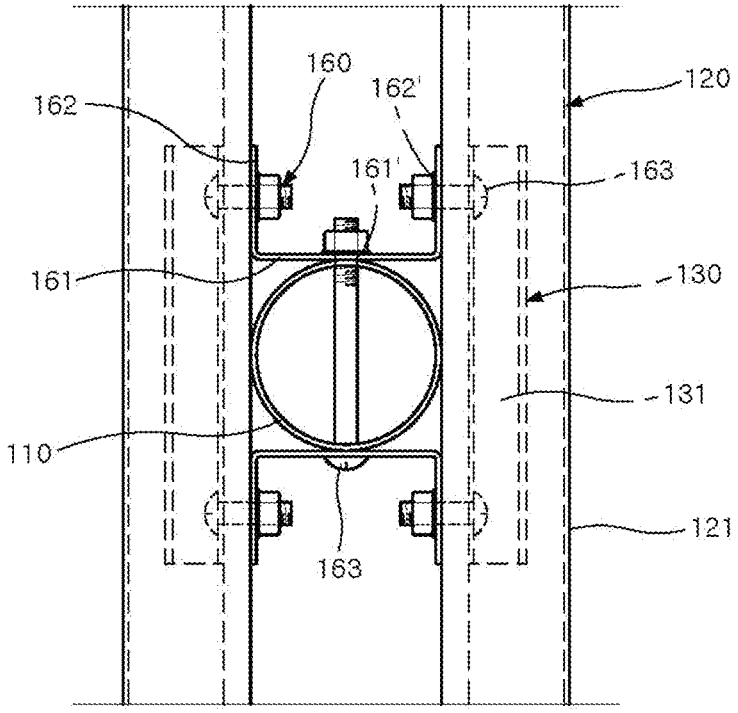
FIG. 8 is a top view showing the state in which the support unit is fixed to the post and the guiderails.

Further, as illustrated in FIGS. 7 and 8, the guiderail 121 may be installed on either one side of both sides of the post 110. When the guiderail 121 is installed on both sides of the post 110, the support unit 160 formed like a '⊏'-type shape is provided on the front and rear sides of the post 110 with support body part 161 of the support unit 160 closely abutted on the outer surface of the post 110 and the support plates 162 bent from both ends of the support body part 161 closely abutted on the guiderail 121.

Here, a fastening hole 161' of the support body part 161 needs to be positioned in line with the through-hole 110' of the post 110, and a fastening hole 162' of the support plate 162 needs to be positioned in line with the slot 122 of the guiderail 121.

In this state, the bolt-type element of the fastening member 163 is threaded out of the support body part 161 through the fastening hole 161' of the support body part 161 and through the fastening hole 110' of the post 110, and then is fastened by a nut.

Further, the bolt-type element of the fastening member 163 is threaded out of the support plate 162 from the bolt-hole 131' of the rail holder 130 through the fastening hole 162' of the support plate 162, and then is fastened by a nut.

Here, since the support unit 160 is fastened to the post 110 and the guiderails 121 with sufficient fastening force, the rail holder 130 may be preferably be fixed to the post, but it is possible to fasten the post 110 and the rail holder 130 using the fastening member 133.

Thus, when the support unit 160 is fixed to the post 110 and the guiderails 121, the contact area with the guiderails connected by the rail connector 140 and thus the fastening strength therewith are further increased, thereby providing a stable support function.

The post 110 may be installed at the ground as an anchor, or otherwise may be buried and installed in the ground.

Figure 9:
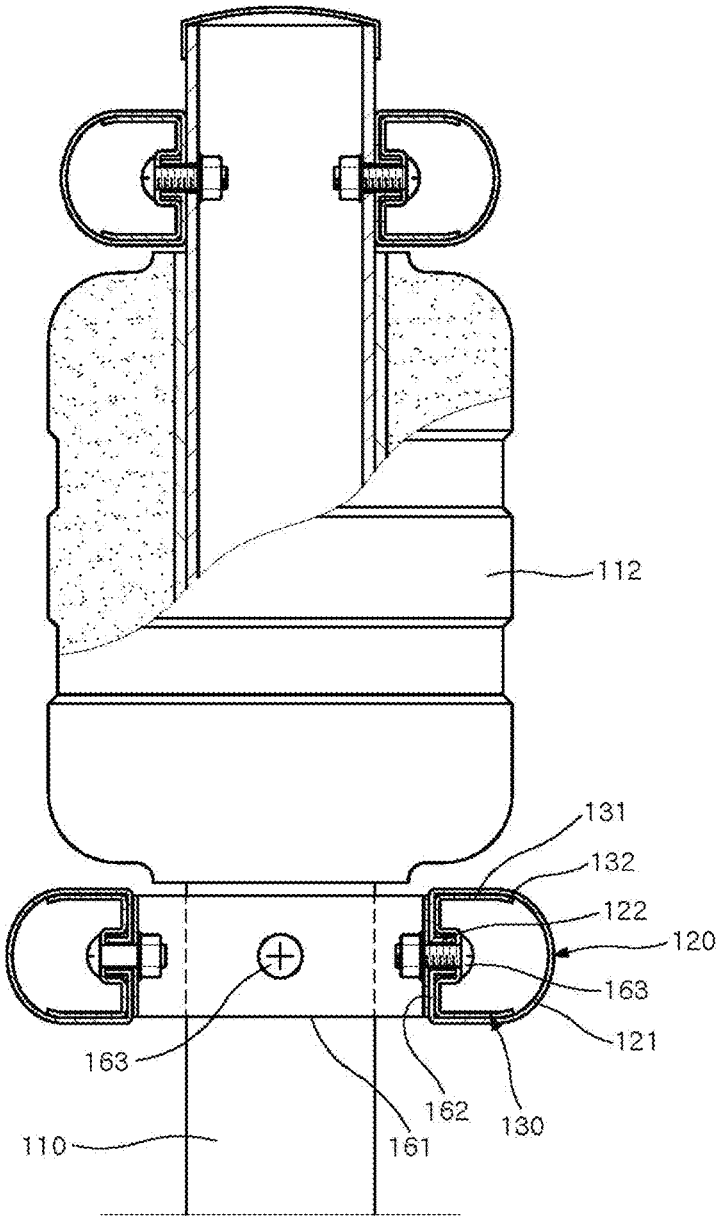
FIG. 9 is a side cross-sectional view the state in which the guiderails are installed in a manner spaced from the post.
Figure 10:
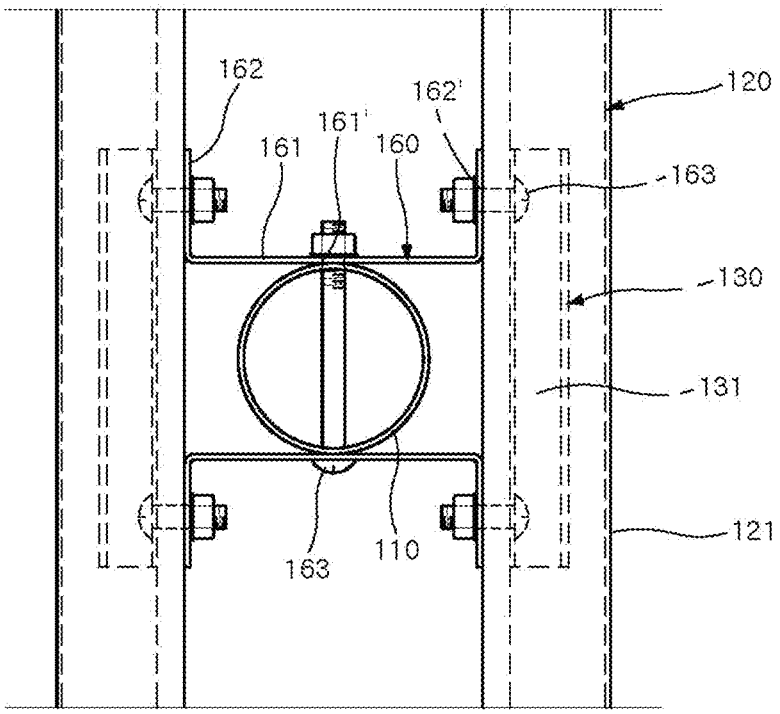
FIG. 10 is a top view showing the state in which the guiderails are installed in a manner spaced from the post.

As illustrated in FIGS. 9 and 10, the support unit 160 allows the guiderails 121, which are to be installed on both sides of the post 110, to be spaced apart a distance from the post 110. A shock-absorbing part 112 made from EVA or soft polyurethane may be rotatably installed on the post 110.

When the support body part 161 of the support unit 160 is closely abutted on the front and rear sides of the post 110, the support plates 162 bent from the opposite ends of the support body part 161 are positioned beyond the outer surface of the post 110, and then the support body part 161 is fastened to the post 110 by the fastening member 163.

The support unit 160 and the guiderails 121 are fixed together by positioning the support plates 162 of the support unit adjacent to the guiderails 121, aligning the slots 122 of the guiderails 121 with the fastening holes 162' of the support plates 162, and fastening the fastening member 163 through the slot 122 and the fastening hole 162'.

When the guiderails 121 are fixed to the support unit 160, the guiderails 121 are fixed with a certain distance spaced apart from the post 110. This serves to further absorb shock by the spaced distance between the post 110 and the guiderails 121.

Figure 11:
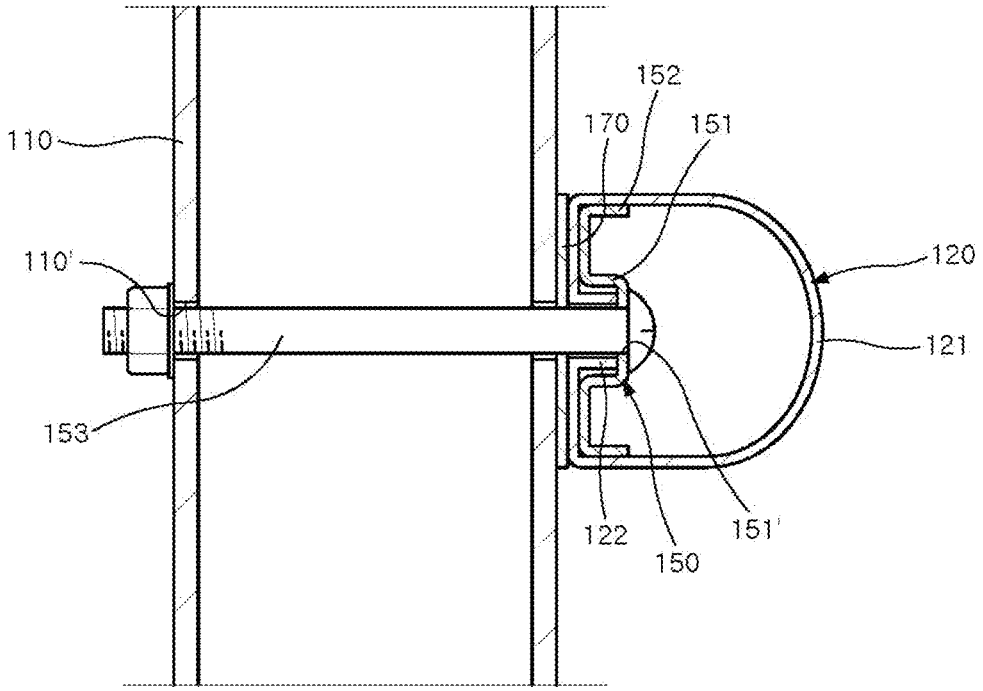
FIG. 11 is a side cross-sectional view showing the state in which the reinforcing section is fixed between the post and the guiderail.
Figure 12:
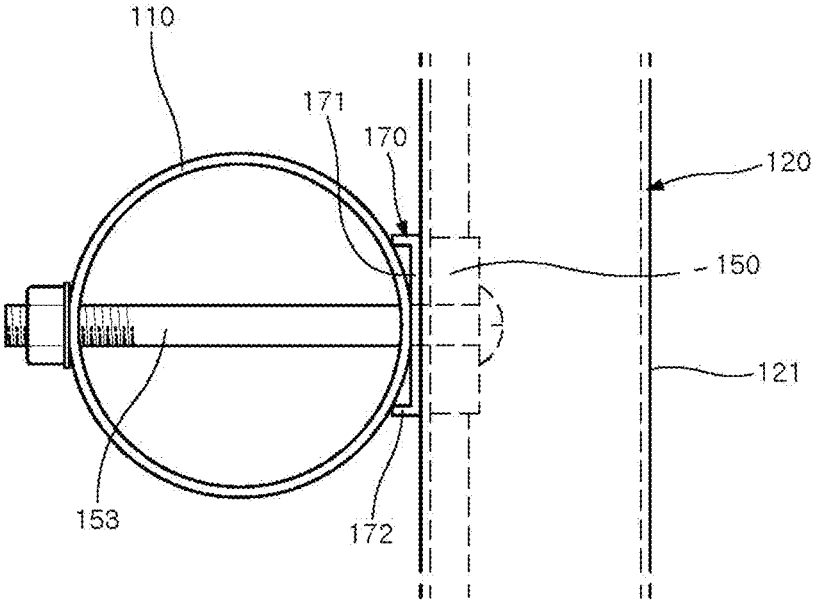
FIG. 12 is a top view showing the state in which the reinforcing section is fixed between the post and the guiderail.

Further, as illustrated in FIGS. 11 and 12, the reinforcing section 170 formed like a '⊏'-type shape is installed between the post 110 and the guiderail 121 to increase the contact area with the guiderail 121 and thus fastening strength with respect to the post 110.

First, the holder unit 150 is coupled into the guiderail so that the bolt-type element of the fastening member 153 is threaded through the bolt-hole 151' of the slot holder piece 151.

When the slot holder piece 151 fastened with the fastening member 153 is installed to enclose the slot 122 of the guiderail 121, the deformation-resistant pieces 152 bent from the opposite ends of the slot holder piece 151 are closely abutted on the inner surface of the guiderail 121.

When the holder unit 150 is installed on the guiderail 121, the '⊏'-type reinforcing section 170 is positioned between the post 110 and the guiderail 121 with the guiderail 121 positioned at a certain height on one side of the post 110.

In this state, the bolt-type element fastened to the holder unit 150 is threaded through the through-hole of the reinforcing section 170 and the fastening hole 110' of the post 110, and a nut is fastened to the bolt-type element from the outside of the post 110, thereby horizontally fastening the guiderail 121.

When the reinforcing section 170 is fastened between the post 110 and the guiderail unit 120, the reinforcing plate part 171 of the reinforcing section 170 is closely abutted on the inner surface of the guiderail 121 to increase the contact area and thus the fastening strength, and the bent pieces 172 bent from the opposite ends of the reinforcing plate piece 171 are closely abutted on the outer surface of the post 110 to prevent the rotation on the outer surface of the post 110 during installation of the guiderail 121, thereby facilitating the installation.

While it has been illustrated that the holder unit 170 is installed on the inner side of the guiderail 121 when the reinforcing section 170 is fixed between the post 110 and the guiderail unit 120, the rail holder 130 may also be installed in the same manner.

TABLE 1

| Collision Test Condition for Evaluation of Strength Performance | |
|---|---|
| Vehicle Weight (kg) | 14,030 (14,000, ±5%) |
| Collision Velocity (km/h) | 65.3 (65, 0~7%) |
| Collision Angle (Degrees) | 15 (15 ± 1.5) |
| Degree of Collision (kJ) | 154.6 (160) |
| Length | 56 m |
| Installation Method | Manual (Bolting) |
| **Collision Test Condition for Occupant Protection Performance** | |
| Vehicle Weight (kg) | 1,340 (1,300, ±5%) |
| Collision Velocity (km/h) | 80.7 (80, 0~7%) |
| Collision Angle (Degrees) | 20 (20 ± 1.5) |

Table 1 shows collision test conditions for evaluating strength performance and occupant protection performance of the traffic barrier structure 100 having the above-mentioned construction upon a collision with a truck and a car.

TABLE 2

| Measuring Items | Reference | Results |
|---|---|---|
| **Collision Test Results for Evaluation of Strength performance** | | |
| Strength | Maintain strength *Truck-blocking Strength | Maintain Truck-blocking Strength |
| Deformation | Maximum Deformation Distance: 0.3 m or less | Maximum Collision Deformation Distance: 0.10 m |
| Dispersion | Not dispersed on or out of the road so as not to injury occupants or a third party | Not dispersed |
| Vehicle state after collision | No overturn or sudden stopping | Overturn and sudden stopping do not occur |
| | The center of vehicle mass does not pass the central line of the traffic barrier structure | The center of vehicle mass does not pass the central line of the traffic barrier structure |
| **Collision Test Results for Evaluation of Occupant Protection Performance** | | |
| Occupant Protection | THIV: 33 km/h or less | THIV: 32 km/h |
| | PHD: 20 g or less | PHD: 5 g |
| | Not dispersed on or out of the road so as not to injure occupants or a third party | Not dispersed |
| | Deformation of internal space of a vehicle | Deformation of internal space of a vehicle |
| | Roof: 100 mm or less, Front side: 75 mm or less, Front Door: 230 mm or less, Collision-side Window: Not broken | Roof: 3 mm, Front windshield 2 mm, Front Door: 7 mm, Collision-side Window: Not broken |
| Vehicle state after collision | Roll, Pitch 75 degrees or less | Roll: 10.52, Pitch: 4.05 degrees |

Figure 13:
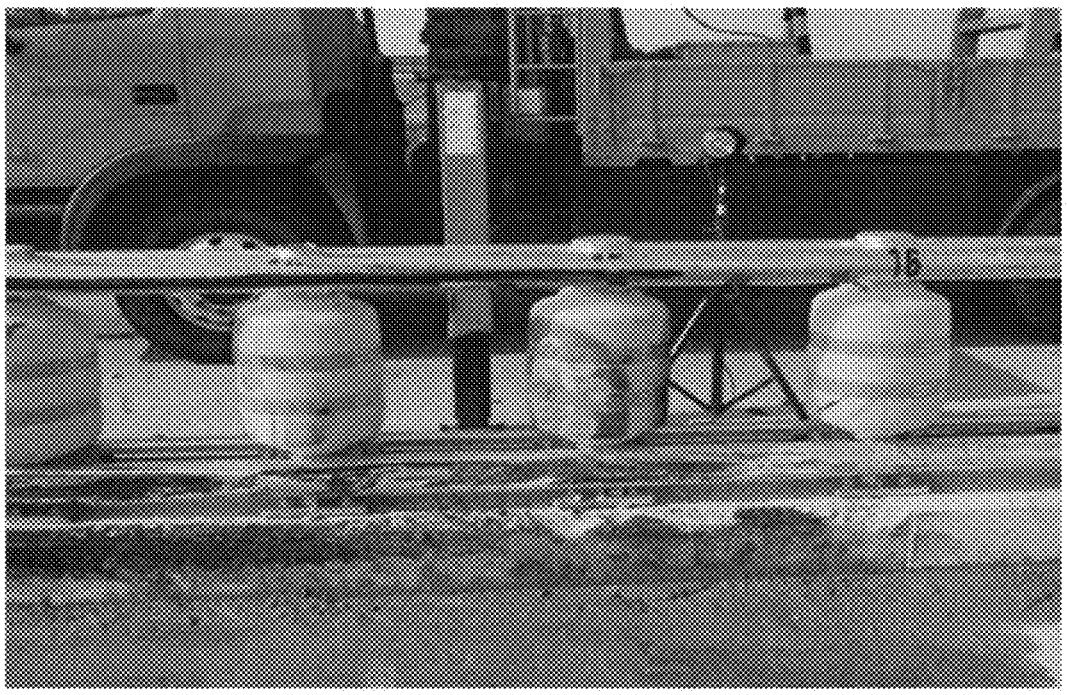
FIG. 13 is a photograph of a collision test for evaluation of strength performance.
Figure 14:
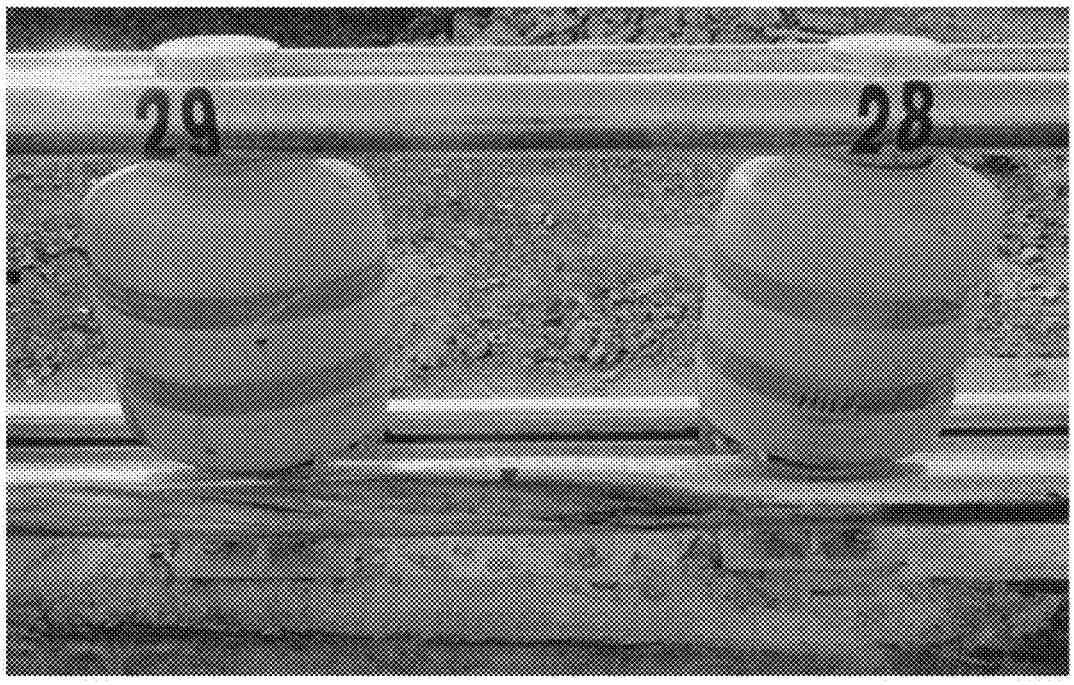
FIG. 14 is a photograph of a collision test for evaluation of occupant protection performance.

As a result of collision test under the condition of Table 1, as shown in Table 2 and FIGS. 13 and 14, the traffic barrier structure 100 showed that a truck-blocking strength is maintained, the stability of a structural member is maintained without breakage of a connector, the maximum collision deformation distance shows an excellent result of 0.10 m that is much smaller than the reference of 0.3 m or less, components are not dispersed during vehicle collision, an overturn of a vehicle is not generated after a vehicle collision, and sudden stopping does not occur after the vehicle collision.

Further, the occupant protection performance showed that the occupant collision velocity (THIV) of 32 km/h satisfies the reference of 33 km/h or less, the occupant acceleration (PHD) of 5 g greatly exceeds the reference of 20 g or less, the degree of deformation in the internal space of a vehicle (that is, roof: 3 mm, front windshield: 2 mm, front door: 7 mm, and Collision-side window: not broken) sufficiently satisfies the reference (that is, roof: 100 mm or less, front side: 75 mm or less, front door: 230 mm or less, collision-side window: not broken).

The terminology used herein should not be interpreted as being limited to common or dictionary definition, but should be interpreted as meanings and concepts conforming to the technical scope of the invention. Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A traffic barrier structure comprising:

a plurality of posts fixedly installed at regular intervals along a median or roadside of a road;

a plurality of guiderail units installed horizontally along the posts, each of the guiderail units including a plurality of longitudinally-aligned guiderails, each guiderail having a hollow cross-section, comprising a curved impact portion facing away from the posts, opposing upper and lower sidewalls, a flat abutment face facing the posts, and a longitudinal slot extending through the abutment face into an interior of the guiderail between opposing inwardly-bent slot sidewalls and longitudinally extending between opposing end portions of the guiderail, each guiderail including a connection part formed at each end portion thereof;

a rail connector inserted into the connection parts of two neighboring guiderails to horizontally connect the two neighboring guiderails in series, the rail connector having a hollow cross-section closely conforming to the inner surfaces of the guiderails, comprising a curved portion facing away from the posts, opposing upper and lower sidewalls, a flat abutment face facing the posts, and a longitudinal slot extending through the abutment face into an interior of the rail connector and longitudinally extending between opposing end portions of the rail connector, the inwardly-bent slot sidewalls of the neighboring guiderails extending through the slot of the rail connector into the interior of the rail connector; and a holder unit disposed within the interior of the rail connector to be fastened to one of the posts, the holder unit comprising:

a washer-shaped slot holder piece having opposing outwardly-bent sidewalls closely conforming to the sidewalls of the longitudinal slots of the guiderails and opposing flat sidewalls conforming to the abutment faces of the rail connector; and a pair of opposing deformation-resistant pieces bent perpendicular to upper and lower edges of the slot holder piece to closely conform to the upper and lower sidewalls of the rail connector to prevent deformation of the guiderails and enlargement of the slots upon a collision of a vehicle with the traffic barrier system, wherein the holder unit is coupled in the rail connector such that a fastening member extends through a hole in the slot holder piece and fastens the neighboring guiderails to the post.

2. The traffic barrier structure according to claim 1, wherein the rail connector has through-holes; and further comprising:

a plurality of connection holes formed in the connection parts of the two neighboring guiderails; and a plurality of connection members fitted through the connection holes and the through-holes.

3. The traffic barrier structure according to claim 1, wherein the guiderail units are installed on both sides of the posts, and further comprising a support unit, wherein the fastening member fastens the guiderails and the rail holder to the post through the support unit.

4. The traffic barrier structure according to claim 3, wherein the support unit comprises:

a support body part closely abutted on the post; and support plates bent from opposing sides of the support body part, wherein the fastening member fastens the guiderails and the rail holder to the post through the support plates.

5. The traffic barrier structure according to claim 4, wherein the support body part further extends to a certain distance so that the guiderails are installed in a manner spaced away a distance from the post, so as to further absorb shock by the certain distance.

6. The traffic barrier structure according to claim 1, further comprising a reinforcing section provided between the post and the guiderails to increase a contact area and thus fastening strength with respect to the guiderails.

7. The traffic barrier structure according to claim 6, wherein the reinforcing section comprises:

a reinforcing plate part to be closely abutted against an inner side of the guiderails and having a through-hole; and bent pieces bent from opposing ends of the reinforcing plate part towards the post so as to be closely abutted against an outer surface of the post.

* * * * *